United States Patent [19]

Weninger

[11] 4,155,179

[45] May 22, 1979

[54] SKI BOOT

[76] Inventor: Peter J. P. Weninger, Karl-Schonherr-Str. 1, Telfs, Austria, A-6410

[21] Appl. No.: 843,135

[22] Filed: Oct. 17, 1977

[30] Foreign Application Priority Data

Oct. 18, 1976 [AT] Austria ..... 7724/76
Dec. 30, 1976 [AT] Austria ..... 9799/76

[51] Int. Cl.[2] ..... A43B 5/04
[52] U.S. Cl. ..... 36/117; 36/132
[58] Field of Search ..... 36/117, 118, 119, 120, 36/121, 132, 61, 62

[56] References Cited

U.S. PATENT DOCUMENTS 3,971,144 7/1976 Brugger-Stuker ..... 36/117

FOREIGN PATENT DOCUMENTS 2363131 6/1975 Fed. Rep. of Germany ..... 36/132
2617257 1/1977 Fed. Rep. of Germany ..... 36/132

*Primary Examiner*—Patrick D. Lawson
*Attorney, Agent, or Firm*—McGlew and Tuttle

[57] ABSTRACT

A ski boot construction comprises a ski boot sole having a bottom substantially planar face with a recess defined in the face centrally between a front sole portion and a rear sole portion forming a heel. A walking aid comprises a member which has a face engageable over the front face portion and an opposite ground engaging face which projects outwardly from the front portion, providing an abutment to raise the front portion off the ground in a walking position so as to cause the vertical center line of the boot to shift to a substantially vertical position. The walking aid is mounted so that it may be moved, for example, pivoted, so that it becomes disposed in the recess between the front and rear portion of the sole, so that the sole defines a surface which again orients the boot so that the center line of the boot is disposed so that it tilts forwardly from the vertical for skiing.

21 Claims, 9 Drawing Figures

SKI BOOT

FIELD AND BACKGROUND OF THE INVENTION

Figure 1:
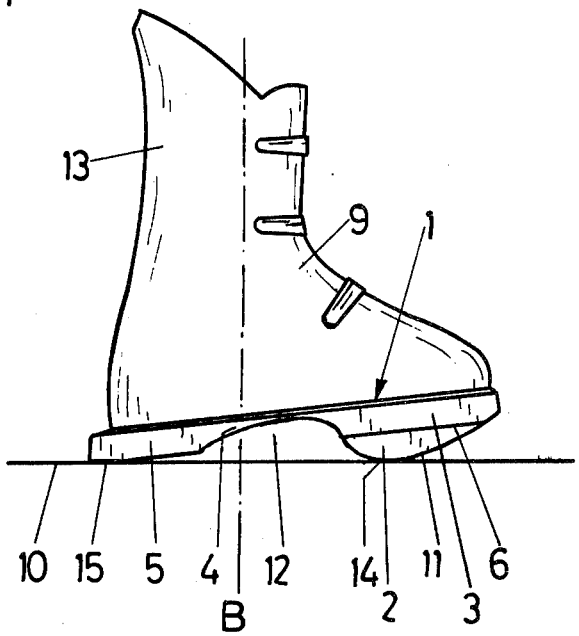

This invention relates in general to the construction of ski boots, and in particular to a new and useful ski boot having a bottom sole with a member which may be positioned at the forward end of the sole to facilitate walking with the ski boot, and which is accommodated within a recess defined between the front and bottom portions of the sole for skiing.

DESCRIPTION OF THE PRIOR ART

To provide a firm seat for the foot in the ski boot, particularly when skiing, and to keep the lower leg in the proper position, modern ski boots are made with soles as rigid as possible, with plane tread surfaces, and with a top slightly inclined forward. But the foot and lower leg position favorable for downhill skiing is at variance with the natural foot position when walking, and therefore makes the walking very difficult.

For this reason, a number of walking aids have already been developed, all of which were unable, however, to solve the problem posed, namely to insure as natural a foot motion or foot attitude as possible when walking, and a simple and easy handling.

Austrian Pat. No. 317,043 and German Utility Model No. 7,344,935, for example, describe a crossbar which may be adjusted in width, and can be fitted to the underside of the boot sole by means of a strap, and must be removed when not in use. German Offenlegungsschrift No. 1,685,739 shows another solution in which the boot sole consists of heel and a thinner front sole which is formed with a transverse rib. The sole of this ski boot makes it possible to walk with a rolling motion of the foot, but is unnecessarily weakened over a large part of its length.

French Pat. No. 1,575,624, German Offenlegungsschrift No. 2,506,751 and German Utility Model No. 1,944,239 show removable soles which extend over the entire boot length and are clamped or strapped on and have an appropriately arched, uneven tread surface. French Pat. No. 1,575,624 further shows an embodiment in which, for walking, a wedge-shaped sole part can be removed from the front sole while, for downhill skiing, it can be inserted in the provided boot sole recess. Such designs again are not the best solution because, while either skiing or walking, the skiers must somehow carry the detached soles or sole parts along.

Finally, a walking aid of the kind mentioned above is known from German Offenlegungsschrift No. 2,550,239. To bring it into its rest or inoperative position, this walking aid is flipped through roughly 270° about hinge pins provided on the rear end of the ski boot sole. From its operative position, it is pivoted to the rear under the front portion of the sole and applies against the top of the ski boot. A yoke which, in the operative position, is set across the front part of the boot is attached to the upper portion of the top and fixes the walking aid in rest position.

This embodiment may cause difficulties when unlocking the walking aid from its operative position because the yoke must be lifted over the usual boot buckles, which is not easily done, particularly with the parts covered with ice and in the cold. Furthermore, this type of walking aid cannot be used with those kinds of modern safety bindings which enclose the heel part to a relatively great extent and where the walking aid must be also taken off, which entails the already mentioned problems of transportation.

Further, recently, some ski boots are made with soles in the shape of ordinary shoe soles, having a heel, a recessed center portion and front portion.

It is an object of the invention to equip a ski boot, having a rigid sole and a plane tread surface, with a walking aid in a manner such as to eliminate the mentioned disadvantages. This means a walking aid which would be simple in design and easy to handle, and both overcomes the problem of transportation and makes a weakening or special design of the boot sole or of the ski boot unnecessary.

According to the invention, this is accomplished in a ski boot of the kind mentioned above by providing the boot sole with a recess which in a manner known per se, accommodates the walking aid in a rest position and into which the walking aid can be moved from its operative position.

In this manner, for walking, the walking aid can be brought into its operative position under and in contact with the front portion of the boot sole while in its rest position, the walking aid is completely received in the boot sole recess above the plane of the boot sole tread.

Various possibilities of design are imaginable for moving the walking aid between the operative and rest positions. A first embodiment provides that the walking aid is rotatable about a horizontal axis extending in the transition zone between the front portion and the center portion of the boot sole, and that the recess is disposed in the center portion under the natural arch of the sole of the foot.

The reason why this embodiment is particularly advantageous is that this center portion of the boot sole is usually the thickest one and the walking aid can be very easily received therein.

A second embodiment of the ski boot according to the invention provides that the walking aid is movable into the recess by at least one link disposed on or in the boot sole.

Preferably two links are provided, one behind the other in the lengthwise direction so as to guide the walking aid parallel during its motion between the rest and operative positions.

The links may be designed, for example, as lateral, approximately U-shaped bows, double T-pieces positioned centrally in the sole, or in any similar way.

A preferred embodiment provides that the boot sole is equipped with a spring which keeps the walking aid in operative position in contact with the front portion and maybe also in the rest position in the boot sole recess. For instance, the boot sole may be provided with a longitudinal recess in which one end of a helical spring is attached, for example, at a location above the axis of rotation of the walking aid or link, while the other end of the spring acts on the walking aid so as to stretch the spring less in the operative and rest positions than during the motion between the two positions.

A third embodiment of the ski boot according to the invention is characterized by at least one slideway extending lengthwise in which the walking aid is disposed so as to be movable between the operative and the rest position.

Particularly suitable as slideways are guide grooves extending from the front area of the boot sole into the recess, each guide groove engaging at least one extension or the like of the walking aid.

The guide grooves may be provided, for instance, in the wall portions of the boot sole which are substantially perpendicular to the plane of the boot sole tread. These wall portions may be formed either by the side walls of the boot sole or by the side walls of one or more longitudinal grooves in the boot sole.

Another possibility of designing the guide groove is, for example, that the guide groove or grooves are open to the tread plane of the boot sole and grow larger, in their depth, the extensions of the walking aid being formed accordingly.

The guide grooves may be formed, for instance, by guide rails inserted in the boot sole.

In another preferred embodiment, the walking aid, in rest position, substantially fills out the space below the center portion. The walking aid is thus not only well accommodated in its rest position, but may also brace the boot sole during skiing, in cases where, to further facilitate walking, the center portion of the sole is made slightly flexible.

This embodiment is suitable, even for skis equipped with a ski brake. To make such a ski brake inoperative during skiing, it is necessary to keep its pedal in contact with the ski surface. For this reason, known ski boots having a recess in their center portion are provided with a lengthwise center bar. Its function is assumed by the walking aid in this embodiment of the invention.

However, not only a spring or the like may serve to fix the walking aid; it is certainly possible to provide the walking aid with a permanent magnet which, in the operative position and preferably also in the rest position, interacts with parts of magnetizable material disposed in the boot sole.

The invention will hereinafter be described in greater detail show reference to the enclosed drawings without, however, being restricted to the shown embodiments. By the same token, the reference symbols used in the following claims are not supposed to mean a restriction; their sole purpose is to facilitate the identification of the parts referred to in the figures.

Figure 2:
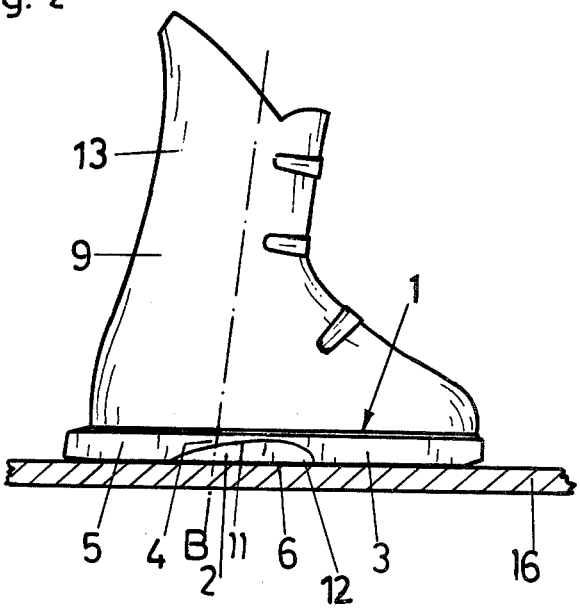
Figure 3:
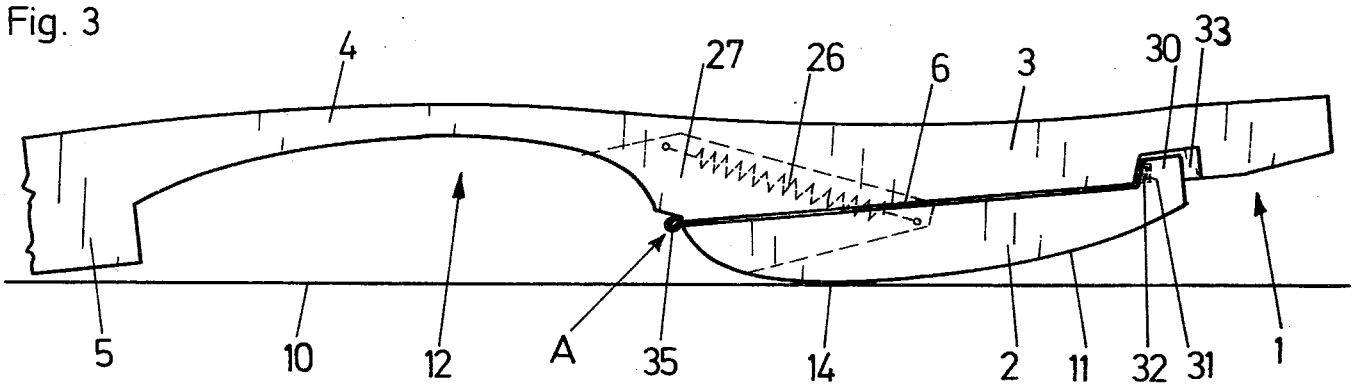
Figure 4:
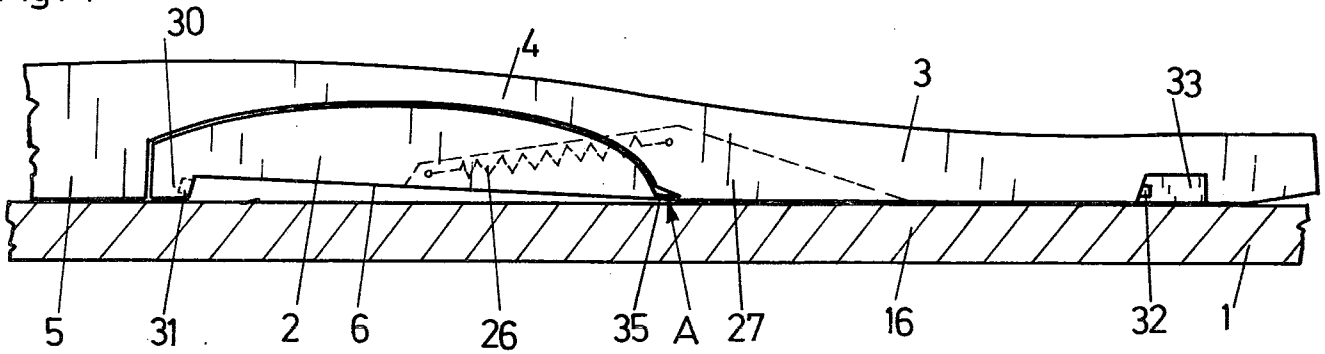
Figure 5:
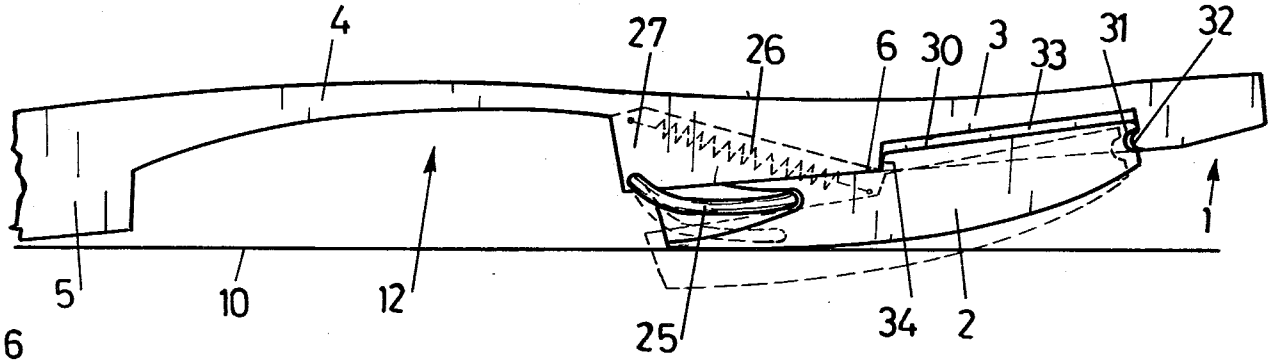
Figure 6:
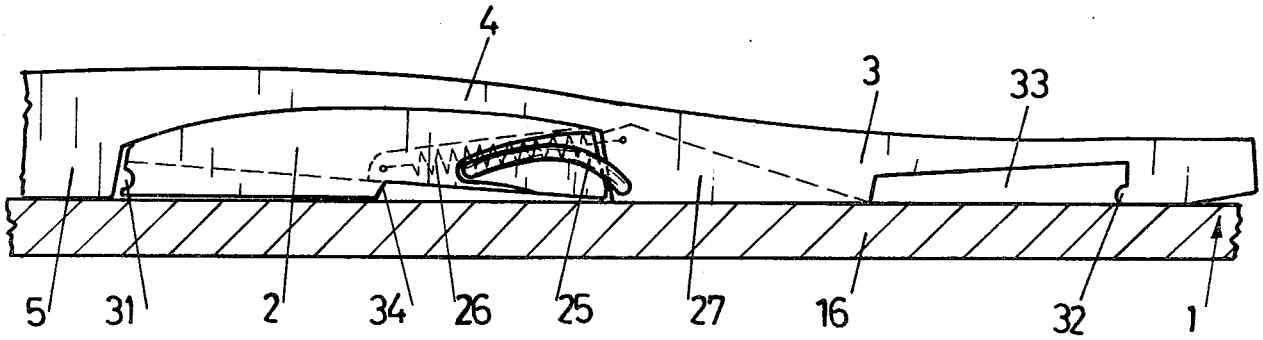
Figure 8:
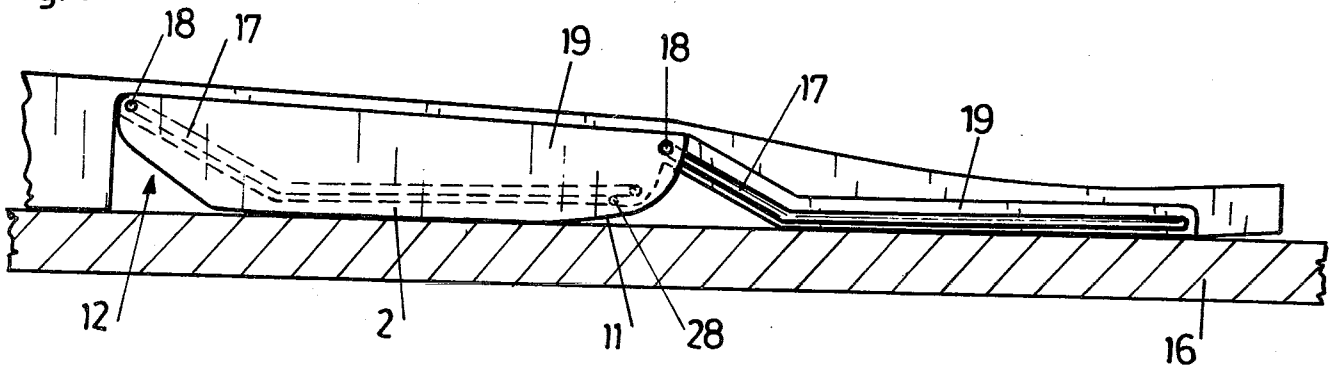
Figure 9:
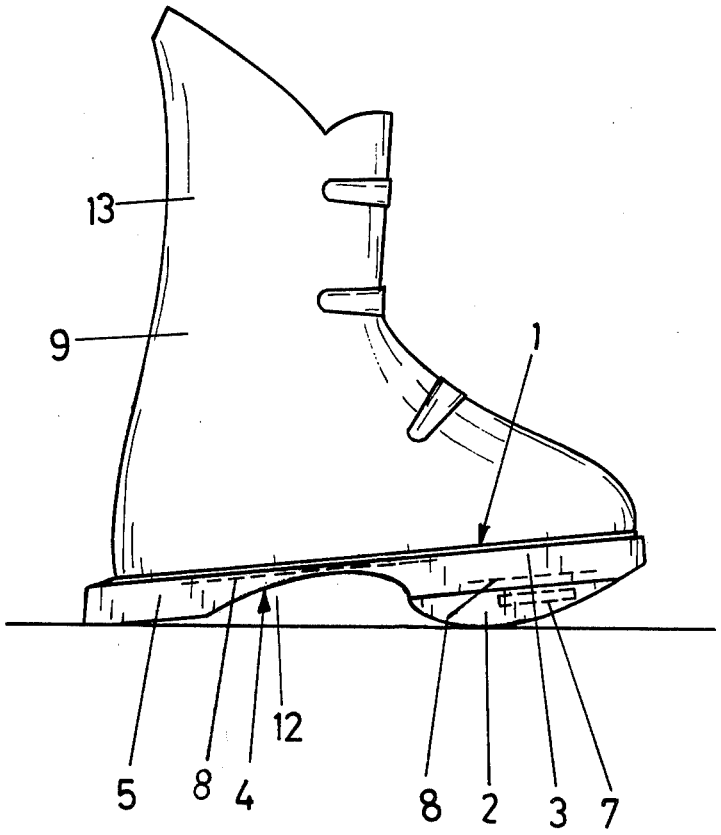

FIG. 1 shows schematically a side view of a ski boot according to the invention with the walking aid in operative position; FIG. 2 in rest position; FIGS. 3 and 4 show a detail of a boot sole with a first embodiment of a pivotable walking aid; FIGS. 5 and 6 show a detail of a boot sole with a second embodiment of a walking aid movable by means of links; and FIGS. 8 and 9 show a detail of a boot sole with a third embodiment of a shiftable walking aid, in operative and rest positions, respectively.

The ski boot 9 is provided with a boot sole 1 comprising a heel 5, a center portion 4 with a recess 12, and a front portion 3. When not in use, the walking aid can be moved into and accommodated in rest position in the free space formed by the recess 12 of center portion 4 and bounded by the tread plane of boot sole 1. Since the recess 12 or free space is preferably formed below the natural arch of the foot, the walking aid can be received at that location very easily and does not require any changes in the thickness of the boot sole.

Walking aid 2 has a convex tread surface 11 and a flat bearing surface 6 for the boot sole 1, the curvature of the tread surface 11 being preferably irregular and substantially wedge-shaped. Tread surface 11 may be provided with a flat 14. Also, it may be profiled, serrated, or the like, to achieve a better adhesive friction on the ground. The size of the walking aid, its curvature, and its exact operative position are governed essentially by the wearer's boot size and are selected so as to attain a ski boot walking motion corresponding as closely as possible to the natural rolling motion of the human foot.

FIG. 1 explains schematically the operative position of walking aid 2. In this position, bearing surface 6 is in contact with the sole surface of front portion 3. Both bearing surface 6 and the sole surface of front portion 3 may be profiled as usual and may also partly engage each other.

As may be seen in FIG. 1, ski boot 9 is supported on a base 10 in the areas of a bevel 15 of heel 5 and of a small flat 14 of walking aid 2. At the same time, the longitudinal axis B of top 13 approximates the vertical, due to the elevation of the front part of th boot, which makes the standing position in the ski boot more comfortable.

FIG. 2 shows the rest position of walking aid 2. In this position, aid 2 is received, as mentioned, in recess 12 of center portion 4, the underside of walking aid 2 being at least flush with the tread plane of sole 1, or even slightly spaced therefrom.

FIGS. 3 and 4 show in detail a first embodiment of the invention, with a pivotable walking aid 2. In its operative position according to FIG. 3, walking aid 2 is pivoted forwardly, and its front bearing surface 6 is in contact with the sole surface of front portion 3. The axis of rotation A is provided in the transition zone between front portion 3 and center portion 4, preferably in the line of intersection of convex tread surface 11 with flat bearing surface 6. The pivotal connection between walking aid 2 and boot sole 1 may be of any design, such as a thin material bridge 35 between walking aid 2 and boot sole 1. Hinges or the like may also be provided, instead.

FIG. 4 shows the rest position of walking aid 2 in this embodiment. In this position, aid 2 is pivoted rearwardly and received in the recess designated 12 in FIG. 3, underneath center portion 4, and bearing surface 6 extends at least flush with the tread plane of boot sole 1.

Walking aid 2 substantially fills recess 12. Thereby, a pedal of a ski brake (not shown) mounted on the ski 16 below center portion 4 is pushed against the ski surface just as with a ski boot having a continuous sole.

In this position, the walking aid 2 may also help to reinforce boot sole 1 during skiing. Walking aid 2 must be fixed, particularly in its operative position.

For this purpose, the boot sole is provided with a central recess 27 in which a helical spring 26 is attached at a location above the axis of rotation A. The other end of the spring acts on walking aid 2 at a point which is spaced from the point of spring suspension in recess 27 more than from axis of rotation A. Thus, the two ends of spring 26 are closer to each other in the operating and in the rest position than during the pivotal motion, so that in these two positions the walking aid is pushed against boot sole 1 or recess 12.

Walking aid 2 is further provided with side cheeks 30 which project from bearing surface 6 and, in operative position, engage two recesses 33 of front portion 3, thereby fixing the walking aid in this position in which also side loads are to be absorbed.

On its face turned toward the axis of rotation A, cheek 30 is provided with a dimple 31 into which, in operative portion, a projection 32 of the boot sole extending into recess 33 engages with snap action. To disengage from this locking in operative position, walking aid 2 is moved slightly forward toward the boot cap while extending spring 26, whereupon it can be pivoted into its rest position.

A second embodiment with a walking aid movable by means of links is shown in FIG. 5 in operative position and in FIG. 6 in rest position.

The walking aid is fastened to a pair of links 25 which are designed, for instance, as substantially U-shaped bows. In this embodiment, too, walking aid 2 has cheeks 30 which project from bearing surface 6 and in operative position engage recesses 33 of front sole portion 3. In this embodiment, dimple 31 is provided in the front face of cheek 30 and again interacts with a projection 32 extending into recess 33. The rear face 34 of cheek 30 is beveled in a manner such that when links 25 are rotated or walking aid 2 is moved into its rest position, first, face 34 slips out of recess 33 and only then walking aid 2 is disengaged from projection 32. Recess 27 in boot sole 1 again accommodates helical spring 26 by which walking aid 2 is retained in its operative and rest positions. In this embodiment, too, walking aid 2 in rest position does not protrude below the tread plane of boot sole 1. Consequently, the ski boot rests on ski 16 in a completely normal manner.

Figure 7:
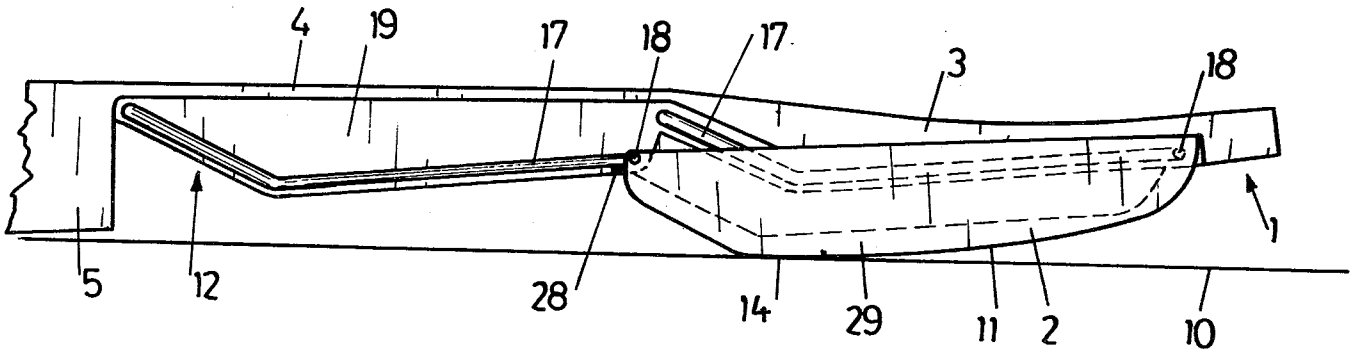

FIGS. 7 and 8 show a third embodiment in which the walking aid can be brought into its operative and rest positions by a shifting motion.

In this embodiment, recess 12 of center portion 4 is extended, with a reduced depth, into front portion 3 toward the boot cap. Both side walls 19 of recess 12 and its extension, which walls are approximately perpendicular tc the tread plane of boot sole 1, are provided with guide grooves 17 into which projections 18 of walking aid 2 are slidably engaged. Due to this design, walking aid 2 can be shifted from its operative position (FIG. 7) into its rest position (FIG. 8), i.e. lifted into and received in recess 12, so that its tread surface 11 is raised, above the tread plane of boot sole 1. Thus, the ski boot can be placed on a ski 16 in the usual position, and including its lateral walls 29, walking aid 2 may extend to the full width of the sole. At least in its operative position, the walking aid can be arrested, for instance, by a resilient pin 28 provided in side wall 19. The guide grooves 17 may be formed by guide rails, for example, which, at the same time, may serve as a reinforcement of the boot sole 1.

For fixing walking aid 2, the design shown in FIG. 9 may also be used. In this design, strips, plates, ribbons or similar elements 8 of a magnetizable material are provided in boot sole 1 and a permanent magnet 7 is embedded in walking aid 2 whereby the walking aid is attached to the boot sole in both positions. Elements 8 may also be formed by the guide rails.

Still further embodiments can be envisioned within the scope of the invention.

It would be possible, for instance, to move the walking aid between the operative and the rest position by means of two links of double T-shape disposed one behind the other in longitudinal direction. Two pairs of U-pieces might also be used instead of the double T-links.

In another design, a guide groove open toward the bottom could be provided, in the boot sole, extending over the center portion and the front portion and engaging with extensions of the walking aid, so that the walking aid would be shiftable along the guide groove.

Walking aid 2 can be made of any suitable material; it is usual to employ the same material as for the boot sole 1, such as plastic, hard rubber, but also wood or the like.

It is also imaginable to design the walking aid as two or more parts received in different recesses of the boot sole.

Furthermore, the front portion 3 of boot sole 1 may also be provided with a bevel in the cap area, forming an extension of the convex tread surface 11 of walking aid 2.

What is claimed is:

1. A ski boot equipped with a removable walking aid which can be moved between an operative position and a rest position and has a bearing surface for contacting the boot sole and a tread surface which is convex in lengthwise direction, with, in operative position, the bearing surface of the walking aid being in contact with the front portion of the boot sole and extending outwardly therefrom and, in rest position, the walking aid being positioned above the tread plane of the boot sole, characterized in that the boot sole (1) is provided with a recess (12) in which the walking aid (2) is received in its rest position and into which the walking aid (2) can be moved from its operative position.

2. A ski boot according to claim 1, characterized in that the walking aid (2) is pivotable about a horizontal axis (A) extending in the transition zone between the front portion (3) and the center portion (4) of the boot sole (1), the recess (12) being disposed in the center portion (4), under the natural arch of the foot sole.

3. A ski boot according to claim 1 characterized in that the walking aid (2) is movable into the recess (12) by at least one link (25) disposed on or in the boot sole (1).

4. A ski boot according to claim 1 characterized in that the boot sole (1) is equipped with a spring (26) which holds the walking aid (2) in contact with the front portion (3), in operating position, and, if provided, within the recess (12) of the boot sole (1), in rest position.

5. A ski boot according to claim 1, characterized by at least one slideway extending lengthwise in which the walking aid (2) can be shifted btween its operating position and its rest position.

6. A ski boot according to claim 5, characterized in that at least one slideway is designed in the form of a guide groove (17) and that the walking aid (2) has at least one projection (18) engaging the guide groove (17).

7. A ski boot according to claim 6, characterized in that the guide grooves (17) are provided in wall portions (19) of the boot sole (1) which extend approximately perpendicularly to the tread plane of the boot sole (1).

8. A ski boot according to claim 5 characterized in that the walking aid (2) is held in operating position and, preferably, also in rest position by a resilient pin (28) fitted in the boot sole (1).

9. A ski boot according to claim 1 characterized in that in rest position, the walking aid (2) substantially fills the recess (12).

10. A ski boot according to claim 1 characterized in that a permanent magnet (7) interacting in the operating position and, preferably, also in the rest position with elements (8) of a magnetizable material which are embedded in the boot sole (1) is disposed in the walking aid (2).

11. A ski boot construction, comprising a ski boot sole having a bottom substantially planar face, a recess defined in said face intermediate the length of said sole, said sole having a front sole portion in front of the recess, a walking aid comprising a member with one face engageable over said front portion and an opposite ground engaging face projecting outwardly from said front portion so as to raise said front portion off the ground in a walking position, said member being of a size to be accommodated in the recess and being positionable in the recess in an inoperative position for skiing.

12. A ski boot construction according to claim 11, including means connecting said member to said sole permitting pivotal movement of said member from said walking position to said inoperative position.

13. A ski boot according to claim 11, including means pivotally supporting said member for rotation about an axis on said sole between said front sole portion and the recess, said member being pivotable about said axis, the recess being defined by an arch in said sole forming a natural arch the foot, said member opposite ground engaging face being of a curvature complementary to said arch and being engageable in the recess with the ground engaging face engaging the arch of the recess.

14. A ski boot according to claim 11, including means pivotally mounting said walking aid member for pivotable movement between the front portion of said sole and the recess and a control lever connected to said member for shifting said member disposed on said boot sole.

15. A ski boot according to claim 11, including means pivotally mounting the trailing end of said member for rotation on said sole between the front portion thereof and the recess, and a spring having one end mounted on said recess and an opposite end connected to said member at a spaced location from said pivotable mounting thereof, in a position to urge said member against said sole in both a position engaged over said front portion and a position engaged in the recess.

16. A ski boot construction according to claim 11, including a slideway defined in said sole between said front portion and the recess, said member being engaged in said slideway and being movable thereon between the walking position and the inoperable position.

17. A ski boot according to claim 16, wherein said slideway includes a guide groove, said member having at least one extension engaging said guide groove.

18. A ski boot according to claim 17, wherein said guide grooves are disposed in a wall part of said boot sole which extends approximately perpendicular to the planar surface of said sole.

19. A ski boot according to claim 11, including detent means engaging said member in both a position in which it is disposed over the front portion of said sole and a position in it is within said recess.

20. A ski boot according to claim 11, wherein said recess conforms to the natural arch of a shoe, said member substantially filling said recess.

21. A ski boot according to claim 11, including magnetic means defined between said member and said sole for holding said sole in both a walking position and in an inoperative position.

* * * * *